United States Patent [19]

Park et al.

[11] Patent Number: 4,460,649

[45] Date of Patent: Jul. 17, 1984

[54] COMPOSITE FIBER

[75] Inventors: Yeun H. Park, Daegu; Jong L. Woo, Kyungsangbuk; Hak M. Kim, Daegu, all of Rep. of Korea

[73] Assignee: Kolon Industries Inc., Seoul, Rep. of Korea

[21] Appl. No.: 414,165

[22] Filed: Sep. 2, 1982

[30] Foreign Application Priority Data

Sep. 5, 1981 [KR] Rep. of Korea ..... 3310/1981[U]

[51] Int. Cl.[3] ..... D02G 3/00

[52] U.S. Cl. ..... 428/373; 264/147; 264/171; 264/177 F; 428/91; 428/290; 428/397

[58] Field of Search ..... 428/373, 374, 397; 264/171, 177 F, 147

[56] References Cited

U.S. PATENT DOCUMENTS

| | | | |
|---|---|---|---|
| 3,853,977 | 12/1974 | Matsui et al. | 264/171 |
| 4,073,988 | 2/1978 | Nishida et al. | 428/397 |

FOREIGN PATENT DOCUMENTS

| | | | |
|---|---|---|---|
| 701354 | 1/1965 | Canada | 264/171 |
| 55-93813 | 7/1980 | Japan | 264/171 |
| 56-53210 | 5/1981 | Japan | 264/171 |
| 2062537 | 5/1981 | United Kingdom | 264/171 |

*Primary Examiner*—Lorraine T. Kendell

*Attorney, Agent, or Firm*—Blum, Kaplan, Friedman, Silberman and Beran

[57] ABSTRACT

The present invention relates to a composite fiber consisting of two components, for example, such as a polyamide and a polyester, and to a multi-segment fiber wherein the two components thereof can be separated into a plurality of microfibers by chemical and physical treatments. Particularly, the invention relates to a composite fiber having low loss of weight in a chemical treatment and which can easily be separated into outer and inner components. After separation the composite fiber provides excellent performance.

4 Claims, 8 Drawing Figures

COMPOSITE FIBER

BACKGROUND OF THE INVENTION

Various types of multi-component fibers with components which can be separated by chemical or physical treatment are well-known in the art. The multi-component fiber shown in FIG. 1 is the so-called "islands-in-a-sea" type composite fiber as shown in U.S. Pat. No. 4,008,344 wherein by employing differences in solubility and separability of a sea component and of islands, the sea component is removed by dissolution or separation thereof so as to separate the fibers of the islands from the sea. In this case, since the sea component occupies a great proportion of the weight of the fiber, its removal by dissolution results in a great loss of weight and is undesirable with respect to cost. Also, great difficulty with waste water treatment is encountered in the separation of the island fibers from the sea.

The fibers shown in FIGS. 2 and 3 are composite fibers as disclosed in Japanese Patent Publication Nos. Sho 53-37927 and Sho 53-47416, wherein components of the fibers are separated gy a physical process. The fibers present many problems in subsequent processes. During drawing, segments may be broken, resulting in formation of a nep, fluff, and the like, and any severe drawing conditions tend to cause breakage of the yarn. Breakage may also occur in the course of twisting or weaving or knitting, causing poor performance in subsequent processes, or defects in a fabric prepared from such fibers. Especially, in the nap raising process, the raised fibers may have irregular lengths, making it impossible to weave or knit a high quality suede-like fabric.

SUMMARY OF THE INVENTION

According to the present invention, a multi-segment type composite fiber consists of a fiber-forming polyamide and a fiber-forming polyester, wherein either the polyester or the polyamide may be the island and the other the sea, or, more aptly, the inner component and the outer component, respectively. In cross-section the inner component comprises a central core and at least five wedge-shaped portions continuous with, or attached, to the core; the narrow end of each web-shaped portion is proximate the core. The outer component is alternately disposed between the wedge-shaped portions of the inner component, and also surrounds the outer, wider ends of the wedge-shaped portions.

Terming the width of the narrow end of each wedge, A, the thickness of the outer component disposed over the ends of the wedges, B, and the radius of the cross-section, R, the construction satisfies the relationships $1/20R < A < \frac{1}{4}R$, and $1/20R < B < \frac{1}{8}R$.

In the composite fiber according to the present invention, the portion of the outer component which surrounds the peripheral portion of the fiber prevents the components from being easily separated. Accordingly, the fiber can be stably drawn and twisted, and has excellent performance in weaving or knitting. Furthermore, when chemically treated, only the peripheral portion is removed, so that the loss of weight in the treatment can be minimized.

Separation of the outer component from the inner component may be carried out by removing only the peripheral portion of the outer component by means of an appropriate chemical process, such as treatment with an acid or alkali, and then, the remainder of outer component by a physical process, such as a raising, and/or a further chemical process, or by a swelling agent, such as benzyl alcohol. In other words, as the composite fiber of the present invention is surrounded in its peripheral portion by the outer component, so the segments are not separated. Thus, the stable operations are carried out until completion of weaving or knitting. The outer component in the peripheral portion is removed, for example, in an acid treatment and alkali treatment, and then, the segments of the outer component are separated from the inner component by means of a raising, to form a microfiber of from 0.1 to 0.5 denier especially suitable for weaving or knitting a suede-like fabric.

Accordingly, an object of the present invention is a composite fiber having an inner component and an outer component where one of the components is of a fiber-forming polyamide and the other being of a fiber-forming polyester.

Another object of the present invention is a composite fiber having wedge-shaped segments about a central core.

A further object of the present invention is a composite fiber having an inner component and an outer component wherein said inner component has at least five wedge-shaped segments about an inner core and said outer component fills the spaces between said segments and overlies the outer ends of said segments.

An important object of the present invention is a fiber having a central core, and at least five wedge-shaped segments about central core, the narrow end of said segments being proximate said core and having a width between 1/20R and $\frac{1}{4}$R, where R is the radius of said fiber.

A significant object of the present invention is an apparatus for spinning a composite fiber having an inner component and an outer component wherein one of said components is a polyester and the other of said components is a polyamide and wherein said inner component includes a central core with at least five wedge-shaped segments contiguous therewith and wherein said outer component fills the spaces between said wedge-shaped segments and overlies the outer ends of said segments.

Yet another important object of the invention is a method of producing a composite fiber having an inner member and an outer member, said inner member having a central core and at least five wedge-shaped segments radiating outwardly therefrom, said outer member filling the spaces between said segments and overlying the outer ends of same.

Still other objects and advantages of the invention will in part be obvious and will in part be apparent from the specification.

The invention, accordingly, comprises the several steps and the relation of one or more of such steps with respect to each of the others, the apparatus embodying features of construction, combinations and arrangement of parts which are adapted to effect such steps, and the article which possesses the characteristics, properties and relation of elements, all as exemplified in the detailed disclosure hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
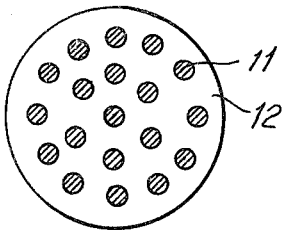
FIG. 1 PRIOR ART
FIGS. 1 through 3 are enlarged cross-sectional views of the prior art composite fibers.

As aforenoted, FIG. 1 shows a composite fiber in which a number of "island" fibers 11 are disposed in a "sea" 12. This type of fiber is uneconomical since removal of the sea component results in a great loss of weight.

Figure 2:
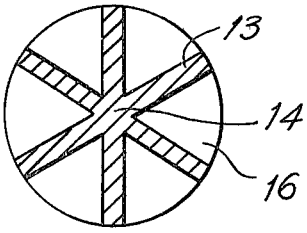
FIG. 2 PRIOR ART
Figure 3:
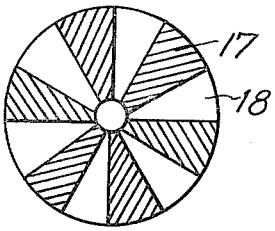
FIG. 3 PRIOR ART

FIGS. 2 and 3 also show composite fibers but these have the difficulty of presenting many problems in subsequent processes. In FIG. 2, segments 13 of constant width emanate from a central core 14, the segments being separated by roughly triangular sections 16, these sections being of a different material than that of which the arms 13 and the core 14 are formed. Also, in FIG. 3, wedge-shaped segments 17 are separated by wedge-shaped segments 18, these segments again being of different materials, but during drawing, segments may be broken and severe drawing conditions have an excessive tendency to cause breakage of the yarn. It is significant that in the constructions shown in FIGS. 2 and 3 the "outer" component does not overlie the ends of the radiating arms.

Figure 4:
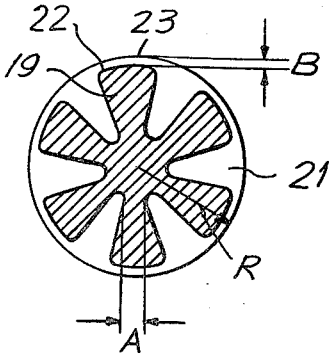
FIG. 4 is an enlarged cross-sectional view of a composite fiber according to the present invention.

In FIG. 4, a preferred embodiment of the composite fiber according to the present invention is shown in cross-section with outer component 21 being entrained between the wedge-shaped branches of inner component 19 and surrounding the outer ends 22 of the branches.

If the thickness, B, between apex or outer end 22 of the wedge and periphery 23 of the cross section of the fiber is equal to or less than 1/20R (where R is the radius of the fiber or zero, as in the prior art fiber shown in FIGS. 2 and 3) separation of segments may easily occur in subsequent processes. However, if the thickness is equal to or greater than $\frac{1}{8}$R, the loss of weight of the outer component during removal of same becomes uneconomically great resulting in an increase of cost. Accordingly, thickness B should be greater 1/20R and less than $\frac{1}{8}$R.

If the minimum width, A, of the wedges is equal to or greater than $\frac{1}{4}$R, processing of the fiber requires very severe conditions, and the loss of weight is too great. Also, if the width, A, is equal to or less than 1/20R, the wedges may be easily cut in the yarn making process or a fiber with an irregular cross-section may result. Therefore, the most preferable width is greater than 1/20R and less than $\frac{1}{4}$R. Also, according to the present invention, the preferable number of wedge-shaped branches of the first component is at least 5 in order to obtain a microfiber (i.e. fibril) of up to 0.5 denier, or from 0.1 to 0.5 denier.

Figure 6:
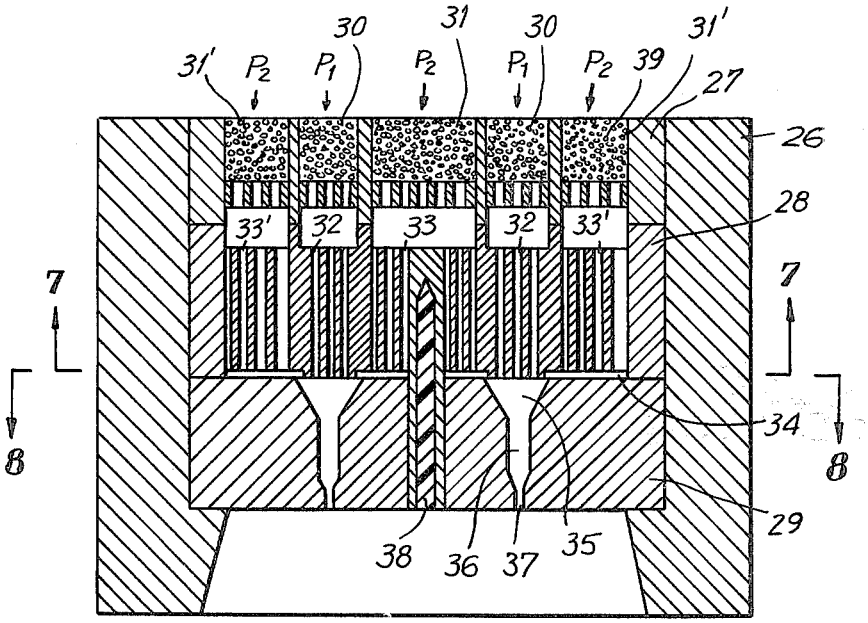
FIG. 6 is a longitudinal sectional view of an apparatus used for forming a composite fiber according to the present invention.
Figure 7:
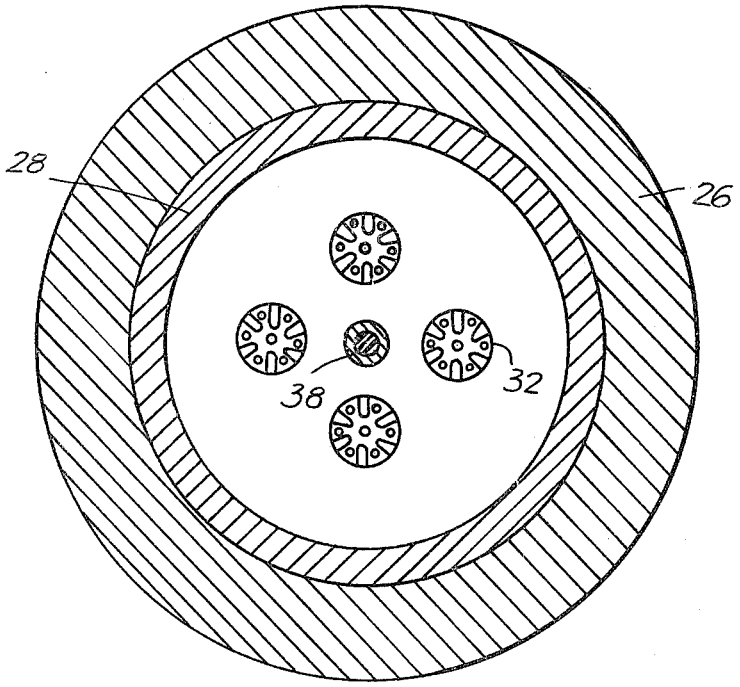
FIG. 7 is a cross-sectional view taken along line 7—7 of FIG. 6.
Figure 8:
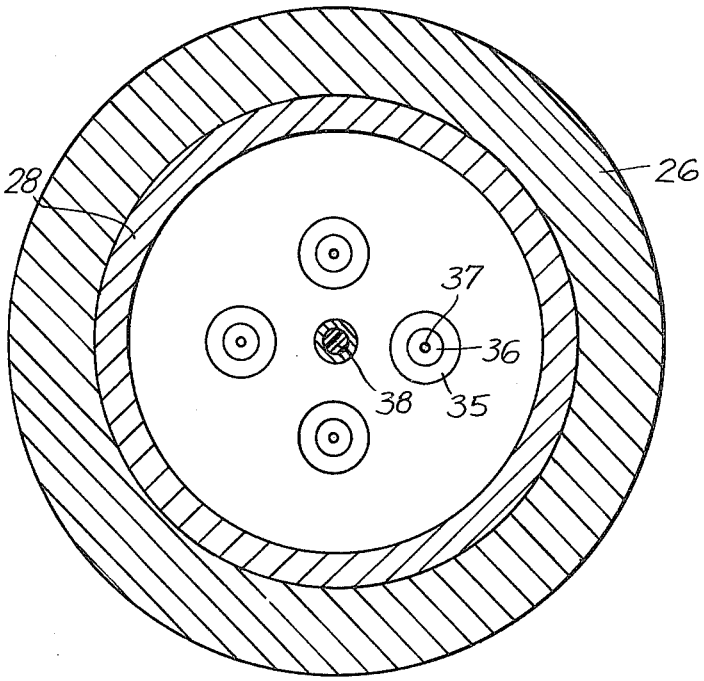
FIG. 8 is a cross-sectional view taken along line 8—8 of FIG. 6.

An apparatus used for spinning the composite fiber according to the present invention is shown in FIG. 6, wherein the spinning apparatus comprises a pack body 26, a cup 27 for molding sand, a guide plate 28, and a spinneret plate 29. Reference number 39 represents filtering sand in cup 27. A method for combining the first and the second components will now be described with reference to FIGS. 6 through 8. The inner component material $P_1$, passes through path 30 into outlet aperture 32 in constant quantity, and then enters opening 35 of guide hole 36. Meanwhile, the outer component material $P_2$ passes through paths 31 and 31' into outlet apertures 33 and 33' in constant quantity to be distributed by distributing plate 28 and then, enters opening 35 of guide hole 36 via path 34 between the distributing plate and the spinneret plate. Then, the outer component material entering opening 35 surrounds the inner component material, and at the same time, penetrates into the spaces between the wedges of the inner component material to be combined therewith. The resulting composite melt issues from orifice 37.

When the composite fiber of the present invention is to be spun by the apparatus shown in FIG. 6, polyamides and polyesters are separately extruded from two separate extruders (not shown) at temperatures of 230°-260° C. and 260°-300° C., respectively and then passed through a common spinning block (not shown) into the apparatus of FIG. 6 for spinning at 260°-300° C. The melt, immediately it issues from the nozzle, is solidified by a cold air current, and the so-formed filaments are wound at a speed of 800-2000 m/min. Then, the undrawn filaments are drawn at an adequate drawing ratio in order to provide them with dynamic characteristics.

When the fiber of the present invention is intended to be used for weaving or knitting a fabric, the fiber may be either in the form of filaments or of staple. In the case of filaments, the drawing is carried out by preheating the filaments by means of heating rollers at 50° C.-100° C., drawing them at a ratio of 1.5-4.5 times according to the degree of molecular orientation desired, and heat-setting them by means of hot plates at 100° C.-250° C. Meanwhile, in the case of staples, following the drawing mentioned above, the filaments are crimped to have about 8-15 crimps per 25 mm by means of a crimping apparatus, such as a stuffing box (not shown). The crimped filaments are heat-treated at a temperature ranging from 20° C. to 130° C. for 30-60 minutes, and cut into staples having lengths of 30-150 mm.

The composite fibers post-treated as mentioned above may be used, in case of filaments, for weaving or knitting fabrics, and in case of staples, for making nonwoven fabrics. After finishing, the fabrics may be used for making suede-like artificial leathers.

Suitable fiber-forming polyamides are nylon 4, nylon 6, nylon 7, nylon 11, nylon 12, nylon 66, nylon 610, polymetaxylene adipamide, polyparaxylene decanamide, polybiscyclohexyl methanedecanamide, and a copolymer of the above polyamides with up to 15 mol % of, a third amide component, or copolymers or mixtures of more than 2 of the above compounds.

Suitable fiber-forming polyesters comprise polyethylene terephthalate, polytetramethylene terephthalate, polyethylene oxybenzoate, poly-1,4-dimethylcyclohexane terephthalate, and a copolymer of the above polyesters with up to 15 mol % of a third ester component, or copolymers or mixtures of more than 2 of the above compounds.

EXAMPLE 1

Nylon 6 having a relative viscosity of 2.6 measured in 96% $H_2SO_4$ at 25° C. was used as the first compound of a composite fiber, and polyethylene terephthalate having an intrinsic viscosity of 0.63 measured in o-chlorophenol at 25° C. was used as the second component of said fiber, and melt spinning was carried out by using a spinning temperature of 290° C. and a composite spinneret of 0.23 mm diameter. The resulting filaments were solidified by a cold air current and wound at a speed of 1300 m/min.

Then, the undrawn filaments were passed through heating rollers at 80° C. to be drawn to 3.1 times their initial lengths. The drawn filaments were heat-set by hot plate at 140° C. to obtain a 70 denier/20 filament yarn having 6 wedge-shaped branches in transverse cross section. Then, the yarn was false-twisted to have twists of 3150 T/M by a Heberlein false-twister at a motor rpm of 25,000 and a heater temperature of 175° C. Table 1 shows the results of experiments on spinning performance, false-twisting performance and rate of separation.

TABLE 1

| Experiment No. | PET①/Nylon② composition ratio | Ranges of A and B | Spinning performance | False-twisting performance | Rate of separation | |
|---|---|---|---|---|---|---|
| 1 | 60/40 | $A = \frac{1}{15} R$ <br> $B = \frac{1}{10} R$ | good | good | 0% | This invention |
| 2 | 80/20 | $A = \frac{1}{3} R$ <br> $B = \frac{1}{15} R$ | " | " | " | Comparative example 1 Performance is satisfactory but processing is difficult. |
| 3 | 20/80 | $A = \frac{1}{18} R$ <br> $B = \frac{1}{4} R$ | " | " | " | Comparative example 2 Performance is satisfactory but weight loss is excessive. |
| 4 | 60/40 | | poor | poor | 20% | Prior art as shown in FIG. 2 |
| 5 | 60/40 | | Slightly poor | Slightly poor | 10% | Prior art as shown in FIG. 3 |

① PET: Polyethylene terephthalate (the outer component).
② Nylon: The inner component.
The rate of separation is the fraction of each separated component in a cross-section of textured yarn after false twisting process × 100.

EXAMPLE 2

Example 1 was repeated, using polyethylene terephthalate having an intrinsic viscosity of 0.70 measured in o-chlorophenol at 25° C. as the inner component of a composite fiber and nylon 6 having a relative viscosity of 3.0 measured in 96% $H_2SO_4$ at 25° C. as the outer component of said fiber. The same results as in Example 1 were obtained.

EXAMPLE 3

Figure 5:
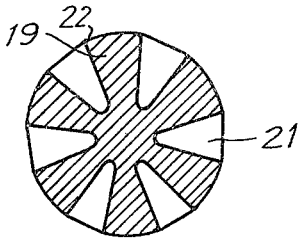
FIG. 5 is an enlarged cross-sectional view of a composite fiber according to the present invention, showing the fiber after chemical treatment.

Broken Twill fabric was woven on a Nissan Water Jet Loom by using, as a weft, a yarn produced in the same manner as in Example 1 and, as a warp, a 75 denier/36 filament polyethylene terephthalate yarn. The density of the warp of the fabric was 101 ends/in. and the density of the weft was 124 picks/in. Then, the fabric was raised, treated with NaOH for reduction of weight until a fiber with a cross section as shown in FIG. 5 was obtained, and further treated with 20% benzyl alcohol to completely separate the second component from the first. After dyeing, post-raising, urethane coating with buffing processes, an artificial suede was made. The results of experiments on the efficiency of weaving, rate of weight reduction and the rate of separation are shown in Table b 2.

TABLE 2

| Experiment No. | Efficiency of Weaving | Rate of Weight Reduction | Rate of Separation |
|---|---|---|---|
| 1 | 95% | 12% | 90% |
| 2 | 95% | 8% | 50% |
| 3 | 93% | 30% | 92% |
| 4 | 85% | | 88% |
| 5 | 90% | | 85% |

$$\text{*Efficiency of Weaving (\%)} = \frac{\text{(Obtained weaving length)}}{\text{(Theoretical weaving length)}} \times 100$$

$$\text{*Rate of Weight reduction (\%)} = \frac{\left\{\text{Dry weight before reducing process}\right\} - \left\{\text{Dry weight after weight reducing process}\right\}}{\text{(Dry weight before process)}} \times 100$$

$$\text{*Rate of separation (\%)} + \frac{\left\{\text{The number of each separated component in a cross-section of the suede fabric}\right\}}{\text{(The total)}} \times 100$$

As shown in Table 2, Comparative Examples 1 and 2 have a high efficiency of weaving, as in the present invention. But Comparative Example 1 has poor separation performance and Comparative Example 2 has an uneconomically great loss of weight.

The sample of experiment No. 1 had the most excellent handling.

EXAMPLE 4

Tricot Satin fabric was knitted on a Karl Mayer Warp-knitting machine by using, as $M_1$ yarn (front), a yarn prepared by the same method as in Example 1 and as $M_2$ yarn (back), a 50 denier/24 filament polyethylene terephthalate yarn. The number of courses was 28 courses/in. (i.e. 28 gauge), and the delivery ratio of yarn was 3:5. The knitted fabric was post-finished in the same manner as in Example 3, and the results shown in Table 3 were obtained.

TABLE 3

| Experiment No. | Efficiency of Knitting | Rate of Weight Reduction | Rate of Separation |
|---|---|---|---|
| 1 | 93% | 10% | 90% |
| 2 | 95% | 6% | 53% |
| 3 | 90% | 25% | 93% |
| 4 | 86% | | 89% |
| 5 | 91% | | 87% |

EXAMPLE 5

A tow was prepared from the filaments obtained by spinning and drawing in the same manner as in Example 1, imparted with crimps by a stuffing box, and cut into staples 50 mm in length. A non-woven fabric having an apparent density of 0.15 g/cm$^3$ was made from the staples by punching by means of needles (#42) to have a density of 1800 needles/cm$^2$. Then, the non-woven fabric was treated to have a cross section of fiber as shown in FIG. 5, and further treated by 20% benzyl alcohol to completely separate the outer component from the inner component. During these processes, operation and separation performances were excellent. Then, the non-woven fabric was coated with urethane and treated by a softening agent. As a result, an articial suede of good quality was obtained.

It will thus be seen that the objects set forth above, among those made apparent from the preceding description, are efficiently attained and, since certain changes may be made in carrying out the above process without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A composite filter having a radius R and comprising an inner component and an outer component, one of said components being a fiber-forming polyamide and the other being a fiber-forming polyester, said inner component having a core and at least five wedge-shaped segments extending radially from said core, each of said segments having a minimum width, A, proximate said core and having an outer end; and said second component being disposed in and filling the spaces between said segments and overlying said outer ends in a layer of thickness, B, where $$1/20R < A < \tfrac{1}{4}R, \text{ and}$$

$$1/20R < B < \tfrac{1}{8}R.$$

2. A composite fiber as defined in claim 1, wherein said fiber-forming polyester is selected from the group consisting of polyethylene terephthalate, polytetramethylene terephthalate, polyethylene oxybenzoate and poly-1, 4-dimethylcyclohexane terephthalate.

3. A composite fiber as defined in claims 1 or 2, wherein said fiber-forming polyamide is selected from the group consisting of nylon 4, nylon 6, nylon 7, nylon 11, nylon 12, nylon 66, nylon 610, polymetaxylene adipamide, polyparaxylene decanamide and, polybiscyclohexyl methane-decanamide.

4. A composite fiber as defined in claim 1, wherein said fiber has a fineness ranging from 0.1 denier to 0.5 denier.

* * * * *